US006488565B1

(12) United States Patent
White et al.

(10) Patent No.: US 6,488,565 B1
(45) Date of Patent: Dec. 3, 2002

(54) APPARATUS FOR CHEMICAL MECHANICAL PLANARIZATION HAVING NESTED LOAD CUPS

(75) Inventors: John M. White, Hayward; Phillip R. Sommer, Newark, both of CA (US)

(73) Assignee: Applied Materials, Inc., Santa Clara, CA (US)

( * ) Notice: Subject to any disclaimer, the term of this patent is extended or adjusted under 35 U.S.C. 154(b) by 66 days.

(21) Appl. No.: 09/651,342

(22) Filed: Aug. 29, 2000

(51) Int. Cl.[7] ..... B24B 13/02

(52) U.S. Cl. ..... 451/5; 451/41; 451/285

(58) Field of Search ..... 451/5, 41, 285, 451/286, 287, 288, 289

(56) References Cited

U.S. PATENT DOCUMENTS

| | | | | |
|---|---|---|---|---|
| 1,577,137 A | | 3/1926 | Maynard | |
| 3,518,798 A | | 7/1970 | Boettcher | 51/131 |
| 3,667,661 A | | 6/1972 | Farmer | 225/2 |
| 3,730,410 A | | 5/1973 | Altshuler | 225/96.5 |
| 3,906,678 A | | 9/1975 | Roth | 51/154 |
| 4,282,924 A | | 8/1981 | Faretra | 165/80 |
| 4,313,284 A | | 2/1982 | Walsh | 51/131.4 |
| 4,344,160 A | | 8/1982 | Gabriel et al. | 367/96 |
| 4,425,038 A | | 1/1984 | La Fiandra et al. | 355/73 |
| 4,508,161 A | | 4/1985 | Holden | 165/1 |
| 4,793,895 A | | 12/1988 | Kaanta et al. | 156/627 |
| 4,930,262 A | | 6/1990 | Sennewald | 51/165.74 |
| 4,954,142 A | | 9/1990 | Carr et al. | 51/309 |
| 5,036,630 A | | 8/1991 | Kaanta et al. | 51/283 R |
| 5,193,316 A | | 3/1993 | Olmstead | 51/281 SF |
| 5,205,082 A | | 4/1993 | Shendon et al. | 51/283 R |
| 5,230,184 A | | 7/1993 | Bukhman | 51/283 R |
| 5,232,875 A | | 8/1993 | Tuttle et al. | 437/225 |
| 5,267,418 A | | 12/1993 | Currie et al. | 51/216 R |
| 5,335,453 A | | 8/1994 | Baldy et al. | 51/67 |
| 5,352,249 A | | 10/1994 | Vollaro | 29/25.01 |
| 5,377,451 A | | 1/1995 | Leoni et al. | 451/287 |
| 5,476,548 A | | 12/1995 | Lei et al. | 118/728 |
| 5,487,697 A | | 1/1996 | Jensen | 451/324 |
| 5,516,327 A | * | 5/1996 | Kawasaki | 451/285 |
| 5,582,534 A | | 12/1996 | Shendon et al. | 451/41 |
| 5,655,954 A | * | 8/1997 | Oishi et al. | 134/62 |
| 5,738,574 A | | 4/1998 | Tolles et al. | 451/288 |
| 5,779,520 A | * | 7/1998 | Hayakawa | 451/285 |
| 5,810,964 A | * | 9/1998 | Shiraishi | 156/345 |
| 5,827,110 A | * | 10/1998 | Yajima et al. | 451/288 |
| 5,830,045 A | * | 11/1998 | Togawa et al. | 451/288 |
| 6,036,582 A | | 3/2000 | Aizawa et al. | 451/41 |
| 6,050,884 A | * | 4/2000 | Togawa et al. | 451/288 |
| 6,068,542 A | | 5/2000 | Hosokai | 451/37 |
| 6,257,966 B1 | * | 7/2001 | Ishikawa et al. | 451/279 |
| 6,361,422 B1 | | 3/2002 | Ettinger et al. | 451/339 |
| 6,379,231 B1 | | 4/2002 | Birang et al. | 451/296 |
| 6,406,359 B1 | | 6/2002 | Birang et al. | 451/67 |

FOREIGN PATENT DOCUMENTS

| | | | |
|---|---|---|---|
| EP | 0047720 A2 | 3/1982 | G01N/1/32 |
| EP | 0674972 A1 | 10/1995 | B24B/37/04 |
| EP | 0747167 A2 | 12/1996 | B24B/37/04 |
| FR | 1224972 | 6/1960 | |
| GB | 2077459 A | 12/1981 | B24B/51/00 |
| JP | 8039422 | 2/1996 | B24B/37/00 |

OTHER PUBLICATIONS

Sommer, "Linear Drive System for Chemical Mechanical Polishing", U.S. Patent Application Serial No. 08/961,602, filed Oct. 31, 1997.

* cited by examiner

*Primary Examiner*—Joseph J. Hail, III
*Assistant Examiner*—Anthony Ojini
(74) *Attorney, Agent, or Firm*—Moser, Patterson & Sheridan

(57) ABSTRACT

Generally, a processing system for polishing a workpiece, such as a semiconductor substrate or wafer, is provided. The system generally includes a first set of load cups that are nested with a second set of load cups. The second set of load cups are disposed adjacent one or more polishing pads. A first and a second polishing head are coupled to a carrier. The carrier is coupled to a drive system that is adapted to move the first and second polishing heads between positions above the first set of load cups, the second set of load cups and a polishing media.

21 Claims, 8 Drawing Sheets

APPARATUS FOR CHEMICAL MECHANICAL PLANARIZATION HAVING NESTED LOAD CUPS

CROSS REFERENCE TO OTHER RELATED APPLICATIONS

This application is related to U.S. patent application Ser. No. 09/570,591, filed Jun. 12, 2000, and U.S. patent application Ser. No. 09/651,527, filed Aug. 29, 2000, both of which are hereby incorporated by reference in their entirety.

BACKGROUND OF THE DISCLOSURE

1. Field of Invention

The present invention relates generally to a substrate planarization system and a method for processing a substrate.

2. Background of Invention

In semiconductor wafer processing, the use of chemical mechanical planarization, or CMP, has gained favor due to the enhanced ability to stack multiple devices on a semiconductor workpiece, or substrate, such as a wafer. As the demand for planarization of layers formed on wafers in semiconductor fabrication increases, the requirement for greater system (i.e., process tool) throughput with less wafer damage and enhanced wafer planarization has also increased.

Two exemplary CMP systems that address these issues are described in U.S. Pat. No. 5,804,507, issued Sep. 8, 1998 to Perlov et al. and in U.S. Pat. No. 5,738,574, issued Apr. 15, 1998 to Tolles et al., both of which are hereby incorporated by reference. Perlov et al. and Tolles et al. disclose a CMP system having a planarization apparatus that is supplied wafers from cassettes located in an adjacent liquid filled bath. A transfer mechanism, or robot, facilitates the transfer of the wafers from the bath to a transfer station. The transfer station generally contains a load cup that positions the wafer into one of four processing heads mounted to a carousel. The carousel moves each processing head sequentially over the load cup to receive a wafer. As the processing heads fill, the carousel moves the processing head and wafer through the planarization stations for polishing. The wafers are planarized by moving the wafer relative to a polishing pad in the presence of a slurry or other polishing fluid medium.

The polishing pad may include an abrasive surface. Additionally, the slurry may contain both chemicals and abrasives that aid in the removal of material from the wafer. After completion of the planarization process, the wafer is returned back through the transfer station to the proper cassette located in the bath.

Optionally, one of the planarization stations may be a buffing station. The buffing station also processes the wafer in a motion similar to the planarization station. The buffing station removes surface contamination, such as loosely adhered particles, so that the wafer may be cleaned more effectively after polishing in a cleaning module that may be located adjacent to or remotely from the CMP system.

Another system disclosed in U.S. Pat. No. 5,908,530, issued Jun. 1, 1999, to Hoshizaki et al., which is hereby incorporated by reference, teaches an apparatus for planarizing wafers wherein the wafer is subjected to uniform velocity across the wafer surface with respect to the abrasive surface. The wafer's motion is provided by a first linear drive and a second linear drive configured to provide x/y motion to a wafer carrier coupled to one of the linear drives. In one aspect, the wafer can be moved in an orbital pattern.

A polishing head is coupled to the wafer carrier to retain the wafer during polishing. Generally, the wafer is positioned in the polishing head by a dedicated load cup that also receives the polished wafers from the polishing head after processing. The polishing head generally stands idle while finished wafers are removed from the load cup and replaced with unpolished wafers.

Since the wafer does not rotate during polishing, all the points on the wafer are subject to a uniform velocity relative to the polishing surface. The uniform velocity across the wafer surface coupled with a multi-programable planarization pattern results in a uniform rate of material removal from the wafer surface. In addition, Hoshizaki et al. provides a number of optional routines that allow a user to fine tune material removal from the wafer.

The systems described above can generally utilize polishing pads with and without abrasive finishes. The polishing pads may be stationary or move relative to the wafer. Additionally, abrasive slurry, de-ionized water and other fluids may be delivered to the polishing pad during wafer processing.

While both the rotational and linear planarization systems have proven to be generally robust polishing platforms, the elimination of the dwell time associated with loading and unloading a polishing head would improve the routing time required to process each wafer, and yield a corresponding increase in wafer throughput (i.e., the number of wafers processed in a unit of time). The increase in wafer throughput has an advantageous effect on both the manufacturing cost of devices fabricated on the wafer, and the cost of ownership associated with the polishing system.

Additionally, compact tool footprints (i.e., the operational area a tool occupies including hardware, access areas and safety buffers) are also desirable. Generally, compact (i.e., small) footprints allow for more processing equipment to be utilized in a given manufacturing area, thus contributing to lower factory overhead and greater wafer throughput.

Therefore, there is a need for an apparatus that provides higher throughput by minimizing the dwell times during wafer transfer between system components while minimizing tool footprint.

SUMMARY OF INVENTION

One aspect of the present invention generally provides a processing system for polishing a substrate. In one embodiment, a processing system includes a first set of load cups that are nested with a second set of load cups. The second set of load cups are disposed adjacent one or more polishing pads. A first and a second polishing head are coupled to a carrier. The carrier is coupled to a drive system that is adapted to move the first and second polishing heads between positions above the first set of load cups, the second set of load cups and the polishing media. Additionally, a transfer station is provided adjacent the loading cup in at least one embodiment.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION OF INVENTION

Figure 1:
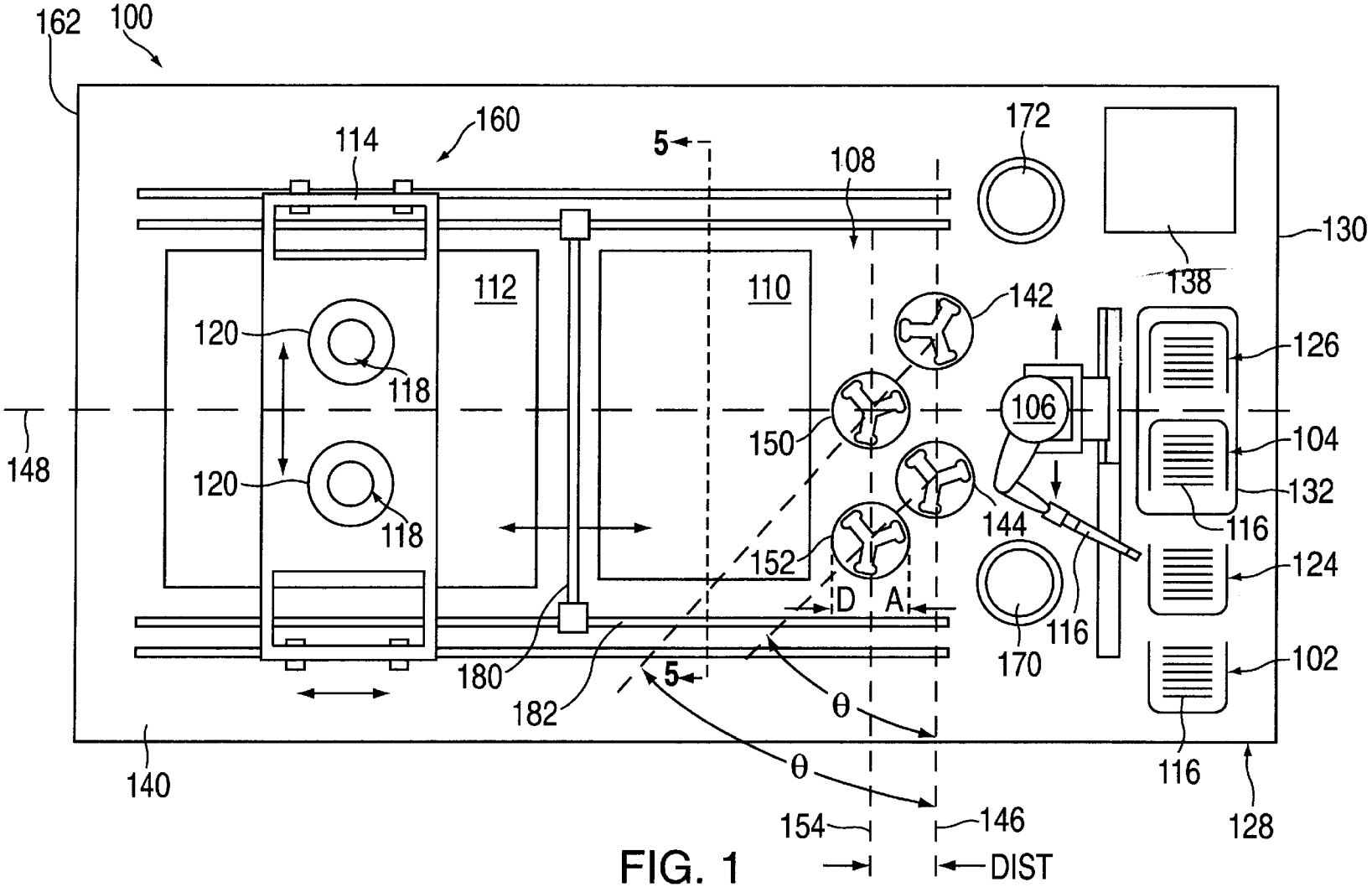
FIG. 1 is a schematic plan view of a chemical mechanical planarization system of the invention.
Figure 2:
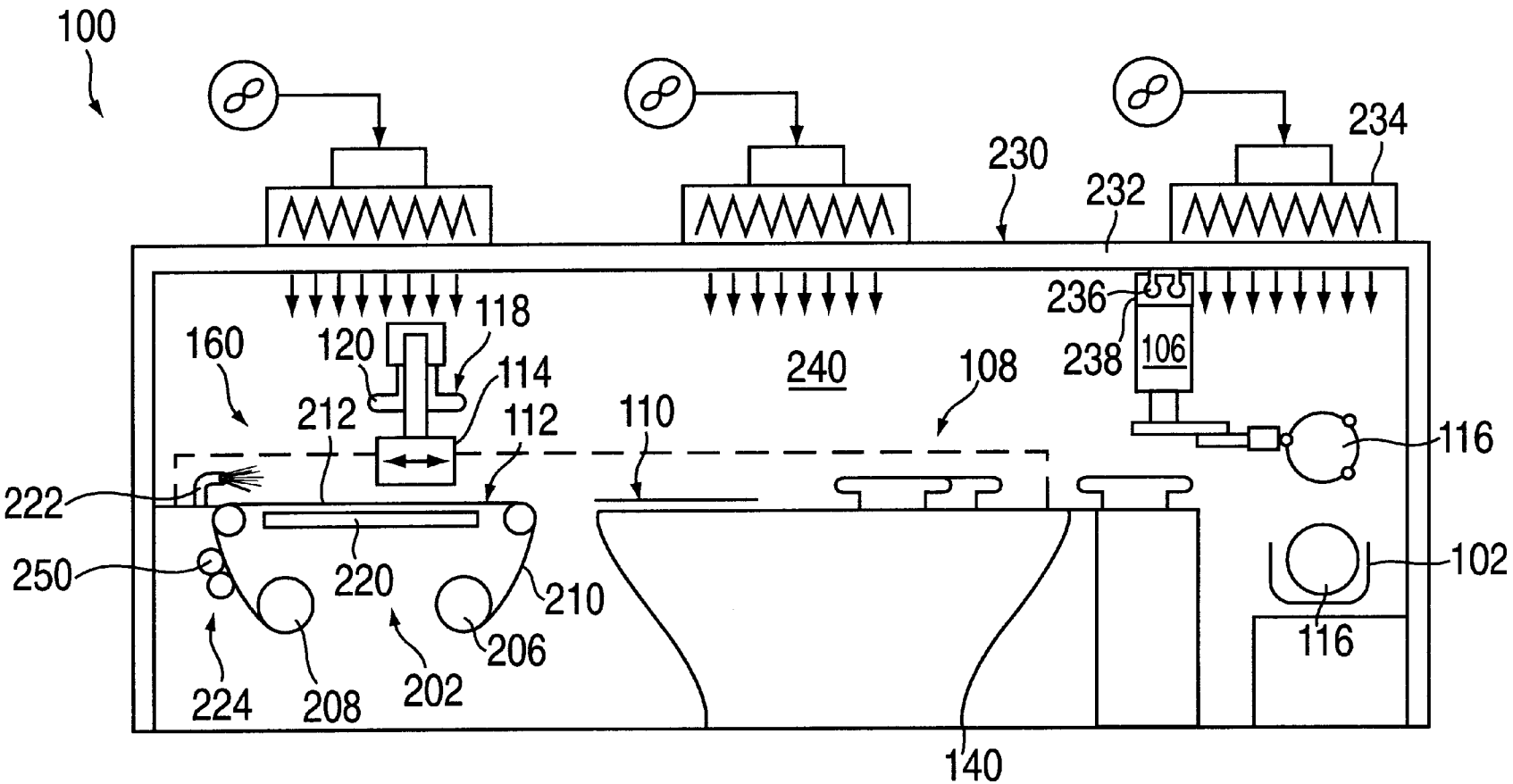
FIG. 2 is a schematic elevation of a chemical mechanical planarization system of FIG. 1.

FIGS. 1 and 2 depict a schematic plan view and an elevation of one embodiment of a chemical mechanical planarization system 100, respectively. The system 100 generally comprises one or more wafer storage cassettes 102 for storing unprocessed substrates, one or more wafer storage cassettes 104 for storing processed substrates, a transfer robot 106, a plurality of load cups 108, a buffing pad 110, a rinse arm 180 and a polishing module 160. The polishing module 160 generally includes a polishing pad 112 and a polishing head assembly 118 supported by a drive system 114. The drive system 114 positions a polishing head 120 of the polishing head assembly 118 such that a substrate disposed in the polishing head 120 may interface with the load cups 108, the buffing pad 110 and the polishing pad 112. The rinse arm 180 is movable along a rail 182 disposed on a base 140 of the system 100. The rinse arm 180 sprays a fluid that may be used to clear contaminants the plurality of load cups 108, the buffing pad 110 and the polishing pad 112 and maintain those surfaces in a wet condition. For clarity, all substrates in the Figures are referred by reference numeral 116.

The system 100 may optionally include a metrology system 138 for obtaining process data from processed (and unprocessed) substrates. Generally, the range of motion of the transfer robot 106 is sufficient to transfer processed substrates 116 into and out of the metrology system 138 prior to being placed in the cassettes 104. Although any number of metrology systems may be employed, one example of a suitable metrology system 138 that measures film thickness is a NOVA™ metrology system available from Applied Materials, Inc., Santa Clara, Calif.

The system 100 is generally enclosed by an enclosure 230. The enclosure 230 is generally a tubular steel or extruded aluminum frame 232 having panels connected thereto to enclose a system environment 240. The panels may be comprised of plastic sheets that may be transparent or opaque. Some of the panels may alternatively be comprised of metallic sheets. Typically, one or more high efficiency air filters 234 are supported by the enclosure 230 to maintain a reduced level of airborne contamination within the environment 240. Such filters are available, for example, from Filtra-Camfil Corporation, located in Riverdale, N.J.

The system 100 generally has a first side 130 and a second side 162 having the base 140 disposed therebetween. The system 100 includes a first port 124 and a second port 126. The first port 124 is disposed in a corner 128 of the system 100. The first port 124 is configured to accept the wafer storage cassettes 102. The cassettes 102 are disposed in the port 124 such that substrates held by the cassettes have a substantially vertical orientation. In one embodiment, the port 124 is configured to receive two cassettes 102.

The second port 126 is disposed along the first side 130 of the system 100 adjacent the corner 128. The second port 126 contains a tub 132 that is configured to accept the wafer storage cassettes 104. The tub 132 generally is filled with a fluid such as de-ionized water that maintains the substrates held in the cassettes 104 in a wet condition. Alternatively, the tub 132 may have water jets (not shown) disposed in a position that wets the substrates within the tub 132. The cassettes 104 are disposed in the tub 132 such that substrates held by the cassettes have a substantially vertical orientation. In one embodiment, the second port 126 is configured to receive two cassettes 104.

The transfer robot 106 is disposed adjacent the ports 124 and 126. The transfer robot 106 is generally a multi-link, single blade robot having a range of motion suitable to transfer the between the load cups 108, and the storage cassettes 102 and 104. To extend the range of motion of the robot 106 while minimizing the size of the linkages, the robot 106 may be mounted to a guide 238 that is movably coupled to a rail 236. The rail 236 is generally disposed parallel to the first side 130 of the system 100. The rail 236 may be disposed on the base 140 of the system, or be suspended above the base 140 from the frame 232 of the enclosure 230. The actuator, generally a linear motion device such as a pneumatic cylinder, hydraulic cylinder, ball screw, servo/stepper motor coupled with belt drives or other linear positional devices, moves the transfer robot 106 along the rail 236.

Figure 3:
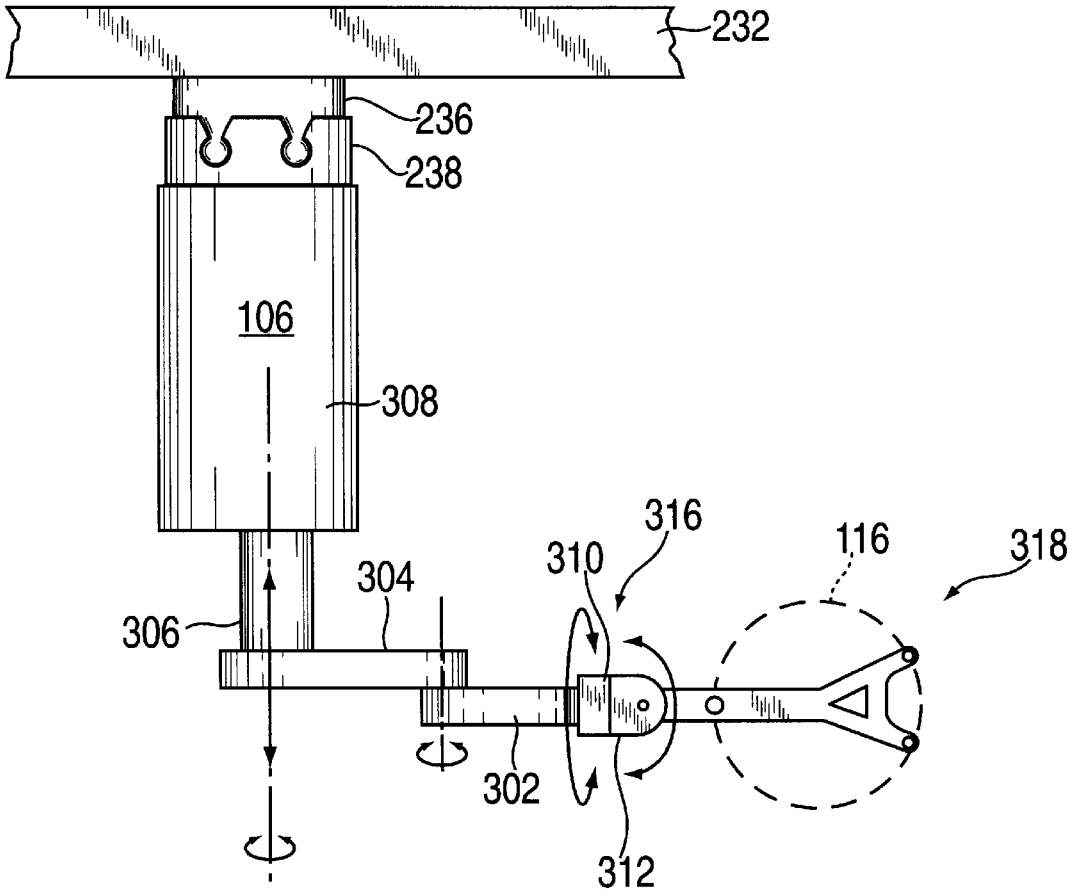
FIG. 3 is an elevation of a transfer robot.

FIG. 3 depicts one embodiment of the transfer robot 106. The transfer robot 106 includes a first arm 302 linked to a second arm 304 coupled to a cylinder 306 that can be actuated through a vertical range of motion from a base 308 of the transfer robot 106. A first rotary actuator 310 and a second rotary actuator 312 comprise a wrist 316 that is coupled to a distal end 314 of the first arm 302. A gripper 318 such as a vacuum blade or edge contact gripper is coupled to the wrist 316. The first rotary actuator 310 allows a substrate 116 to be held by the gripper 318 to be orientation either horizontally or vertically. The second rotary actuator 312 permits the gripper 318 to be orientated vertically such that the gripper 318 may be inserted between substrates disposed in the cassettes 102, 104 to retrieve (or dispose) a substrate without disturbing neighboring substrates disposed in the cassette. The substrate is generally flipped 90 degrees during transfer by the transfer robot 106 such that the wafer is orientated horizontally "feature side-down" when disposed or supported in the load cups 108, and vertically "on-edge" when in the cassettes 102, 104. The gripper 318 secures the substrate during transfer by the transfer robot 106. Optionally, other types of grippers may be utilized, such as edge clamps, electrostatic chucks and the like. One skilled in the art will recognize that other types of wafer transfer robots having a suitable range of motion may be alternatively utilized.

Returning to FIG. 1, the plurality of load cups 108 are generally disposed on the base 140 and orientated generally parallel to first side 130 of the system 100. The buffing pad 110 is typically disposed on the base 140 adjacent the load cups 108. The polishing module 160 is disposed on the base 140 between the buffing pad 110 and the second side 162 of the base 140. The orientation of the polishing module 160 and buffing pad 110 define an imaginary line 148 along the length of the system 100 between the first side 130 and second side 162.

The plurality of load cups 108 are generally grouped into sets of load cups. Typically, one set of load cups is designated for clean substrates in order to minimize contamination of substrates before processing while the other set of load cups handle substrates after processing. Generally, at least two load cups are utilized for each polishing head of the polishing module 160. For example, a system comprising three polishing heads in one polishing module may utilize six load cups while a system comprising two polishing heads each on two polishing modules may utilize eight load cups. The use of multiple polishing heads for each polishing head increases substrate throughput by having one load cup available for unloading a polished substrate while having an unpolished substrate queued in another load cup waiting to be polished.

In one embodiment, the load cups 108 include a first set of load cups having a first load cup 142 and a second load cup 144 positioned adjacent to the buffing pad 110. The first and second load cups 142, 144 are disposed on the base 140 proximate the transfer robot 106. The centers of the first and second load cups 142, 144 define an imaginary line 146 that is generally perpendicular to the imaginary line 148. A second set of load cups comprises a third 150 and a fourth load cup 152. The third load cup 150 and the fourth load cup 152 are disposed on the base 140 between the first and second load cups 142, 144 and the buffing pad 110. The centers of the third and fourth load cups 150, 152 define an imaginary line 154 that is parallel to the imaginary line 146. The load cups 142, 144, 150 and 152 generally are nested or staggered such that the distance between the centers of the two sets of load cups (i.e., the distance "DIST") is less than a diameter "DIA" of the load cups 108. The nested load cups 108 occupy a minimal amount of area on the base 130 that advantageously minimizes the footprint of the system 100.

In one embodiment, the centers of the load cups 142, 144 are positioned at an angle θ relative the respective centers of load cups 150, 152 in relation to the imaginary line 150. By decreasing the angle θ, the length of the system may be reduced. In one embodiment, θ is in the range of 15 to 75 degrees.

The load cups 108 may comprise any variety of load cups known to those in the art for positioning wafers into a polishing head of a polishing module. Examples of such load cups are described by Tobin in the commonly assigned U.S. patent application Ser. No. 60/139,124, Attorney Docket No. 3650, filed Jun. 14, 1999, and by Sommer et al., in U.S. patent application Ser. No. 60/169,770, both of which are hereby incorporated by reference. The load cups 108 may optionally comprise other configurations.

Figure 4:
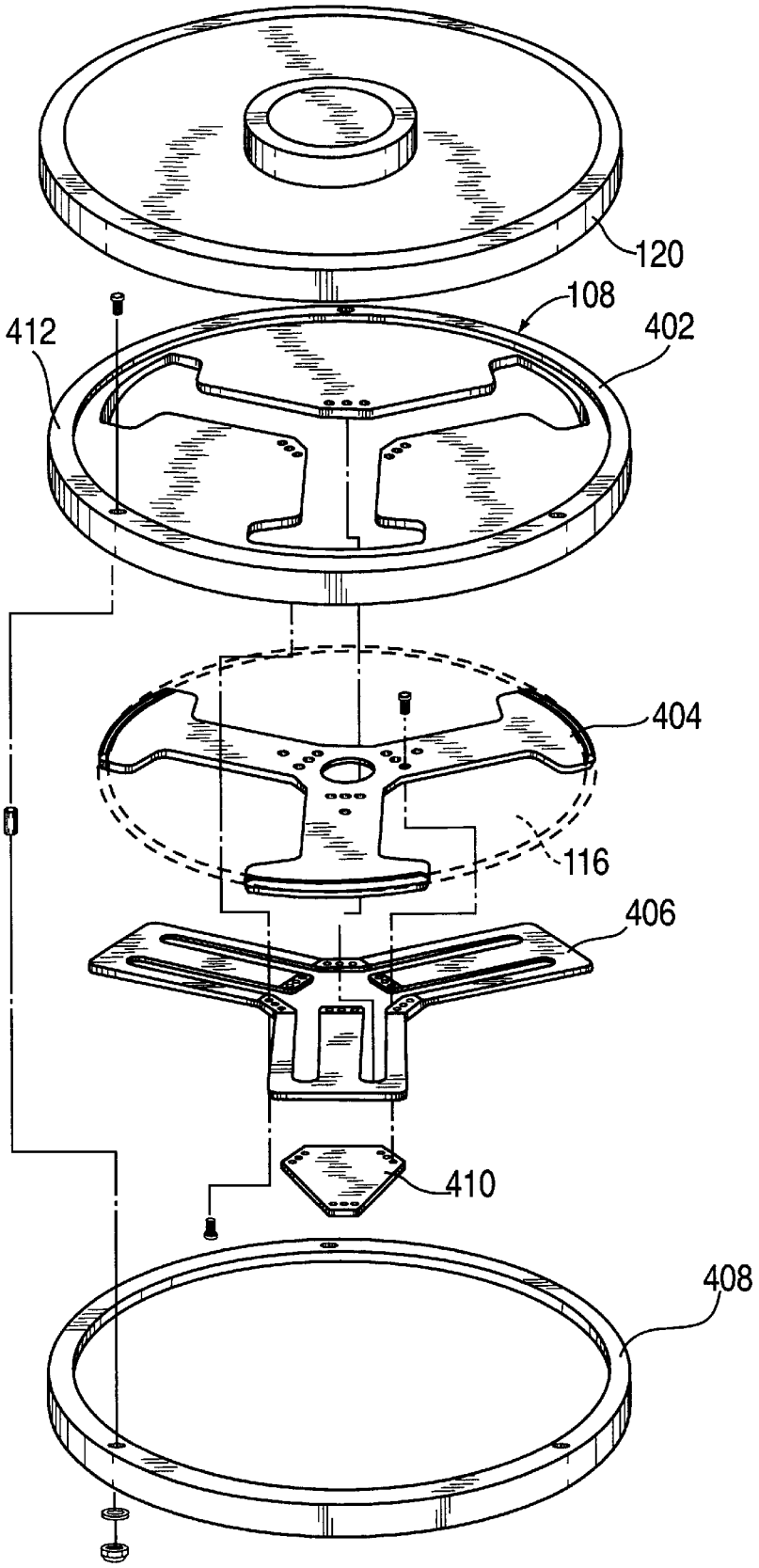
FIG. 4 is an exploded view of a load cup.

Referring to FIG. 4, one embodiment of the load cups 108 indudes a cone 402 and chuck 404 coupled by a flexure 406. The flexure 406 maintains the cone 402 concentric to the chuck 404. The chuck 404 is configured to hold the substrate 116 (shown in phantom in FIG. 4). The cone 402 is movably supported by a ring 408. As the load cup 108 containing the substrate 116 is elevated by the ring 408 to interface with the polishing head 120, a lip 412 of the cone 402 contacts the under portion of the polishing head 120. The lip 412 and polishing head 120 interaction causes the load cup 108 to move laterally, concentrically aligning the load cup 108 with the polishing head 120. The flexure 406 maintains concentricity between the cone 402 and the chuck 404 as the cone 402 aligns the load cup 108 with the polishing head 120. The flexure 406, which is clamped to the chuck 404 by a retaining plate 410, permits the chuck 404 to move axially relative to the cone 402 thus accurately locating the substrate 116 within the polishing head 120.

Figure 5:
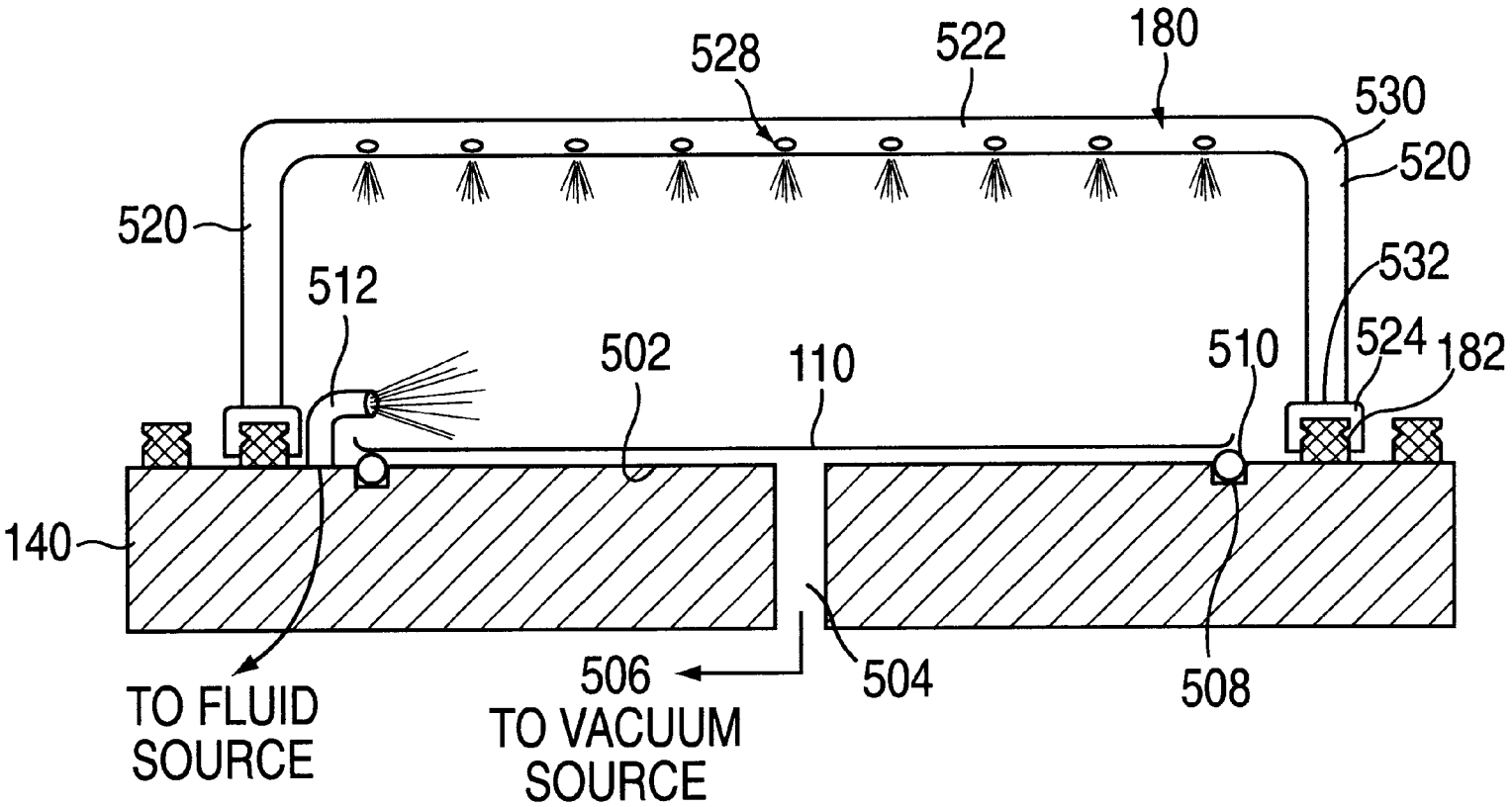
FIG. 5 is a cross sectional view of a buffing pad taken along section line 5—5 of FIG. 1.

Referring to FIGS. 1 and 5, the buffing pad 110 is generally a removable film that may optionally contain a textured surface. The buffing pad may be a stick down pad or a web of buffing material. The buffing pad 110 may comprise a conventional buffing pad such as those available from Rodel, Inc., of Newark, Delaware, or a fixed abrasive pad such as those available from Minnesota Mining and Manufacturing Company, St. Paul, Minn.

A region 502 of the base 140 that supports the buffing pad 110 contains a passage 504 that places a vacuum source 506 in communication with the underside of the buffing pad 110. The region 502 has a groove 508 formed therein that accepts a seal 510. The groove 508 and seal 510 generally conform to the perimeter geometry of the buffing pad 110 such that a vacuum may be maintained between the buffing pad 110 and the base 140, thus, retaining the buffing pad 110 to the base 140. The vacuum securely holds the buffing pad 110 in place while the substrate 116 is buffed. Advantageously, the vacuum allows the buffing pad 110 to be secured to the base 140 without the use of mechanical clamps or adhesives. As such, the buffing pad 110 may be readily removed and replaced when required, for example, when the surface of the pad becomes glazed. Alternatively, other means, such as temporary adhesives, for removably fixing the buffing pad 110 to the base 140, may be employed in place of the vacuum. An example of a similar pad retained by a vacuum is disclosed in U.S. patent application Ser. No. 09/258,042, filed Feb. 25, 1999, by Sommer, and is hereby incorporated by reference in its entirety.

Optionally, one or more fluid nozzles 512 are coupled to a fluid source (not shown) and may be positioned to flow a fluid such as de-ionized water or buffing medium on the buffing pad 110 to augment the buffing process or to clean the pad between buffing operations. Typically, the nozzles 512 are coupled to an arm that may be actuated to position the nozzles 512 such that the entire buffing surface may be wetted.

The rinse arm 180 is optionally disposed above the base 140. The rinse arm 180 is coupled to a rail 166 that is disposed on the base 140. The rinse arm 180 is generally movable along the base 140 and may be positioned to dispense fluid on the load cups 108, the polishing pad 112 or the buffing pad 110. A pair of stanchions 520 has a first end 530 and a second end 532. Generally, the stanchions 520 are short enough as to allow the rinse arm 180 to pass between the polishing head assembly 118 and the base 140 when the polishing head assembly 118 is in a raised position. The first end 530 of the stanchion 520 is coupled to the rinse arm 180. The second 532 of the stanchion 520 is coupled to a guide 524. The guide 524 movably couples the rinse arm 180 to the rail 182. The guide 524, which may be a roller or solid bearing, allows the rinse arm 180 to move along the rail 182. The rinse arm 180 additionally includes a plurality of apertures or nozzles 528 disposed along the rinse arm 180 between the stanchions 520. The nozzles 528 are coupled to a fluid source (not shown) which supplies a fluid such as de-ionized water to keep surfaces (load cups 108, the polishing pad 112 and the buffing pad 110) wet and to sweep away possible contamination disposed thereon. Optionally, polishing fluid or buffing fluid may be dispensed from the rinse arm 180.

Returning to FIGS. 1 and 2, the polishing module 160 may include buffing, polishing, rinsing, cleaning and/or other processing apparatus associated with polishing a workpiece. The polishing pad 112 may be a foamed polymer pad having a smooth, porous or textured surface. The polishing pad 112 may contain a fixed abrasive surface. The polishing pad 112 may be used with chemical agents or de-ionized water (i.e., polishing fluid) that may additionally include abrasive particles. The polishing pad 112 may be either a stick-down polishing pad or web of material. For example, the polishing pad 112 may include a coating of pressure sensitive adhesive on a side of the pad opposite the working surface. The adhesive removeably fixes the pad to the platen during polishing.

In one embodiment, the polishing module 160 comprises a polishing media magazine 202 interfaced with the drive system 114. The polishing media magazine 202 generally comprises an unwind 206 and a winder 208. The polishing pad 112 is the form of a web of polishing media 210 is run between the unwind 206 and the winder 208. The web of polishing media 210 can be substantially "rolled-up" at either the unwind 206 and the winder 208, or partially wound on both the unwind 206 and the winder 208 such that various portions of the web 210 may be selectively exposed between the unwind 206 and the winder 208. The web of polishing media 210 may be indexed or advanced, between or during wafer processing. The web of polishing media 210 is run parallel (as shown in FIGS. 1 and 2) or perpendicular to the imaginary line 148. When processing 300 mm wafers, it is preferred to orientate the web 210 perpendicular to line 148 or utilized a second web not shown parallel to the line 148 so that one substrate may be polished on a respective web simultaneously.

The web of polishing media 210 is generally comprised of a thin polymeric film having a working surface comprising fixed abrasive covering at least a portion of the width of the polishing media 210. The polishing media 210 should be substantially impermeable to the polishing fluid (i.e., a slurry, deionized water or other fluid media that assists in polishing). The working surface may optionally comprise an abrasive coating, finish, covering, texture or combination thereof.

A working surface 212 of the web of polishing media 210 is disposed on a polishing plate 220 that is coupled to the base 140 of the system 100. A nozzle 222 is disposed on the base 140 adjacent each web of polishing media 210 so an optional slurry or other fluid used during wafer processing may be disposed on the working surface 212 of the web of polishing media 210. Optionally, the working surface 212 may comprise an abrasive coating, finish, covering and/or texture. An example of such a polishing media magazine configured to handle a single web which may be modified to benefit from the features of this invention is described in the previously incorporated U.S. patent application Ser. No. 08/833,278, filed May 4, 1997, by Donohue et al., and is hereby incorporated by reference.

The polishing media magazine 202 may further comprise a conditioning device 224. Generally, the conditioning device 224 comprises two rollers 250 driving in opposing directions that are selectively actuated against the working surface 212 of the web of polishing media 210 to condition the working surface. The conditioning device 224 conditions (i.e., dresses) the working surface 212 of the web of polishing media 210 to create a uniformly textured surface generally by forming a topography that retains the polishing fluid during processing that removes material from the surface of the substrate 116 at a uniform rate. Other types of conditioning devices 224 may optionally be utilized alone or in conjunction with the rollers 250. Examples of such devices are described in U.S. patent application Ser. No. 60/172,416 (attorney docket no. AMAT 4386L), filed Dec. 17, 1999, by Sommer et al, and is hereby incorporated by reference.

Figure 6:
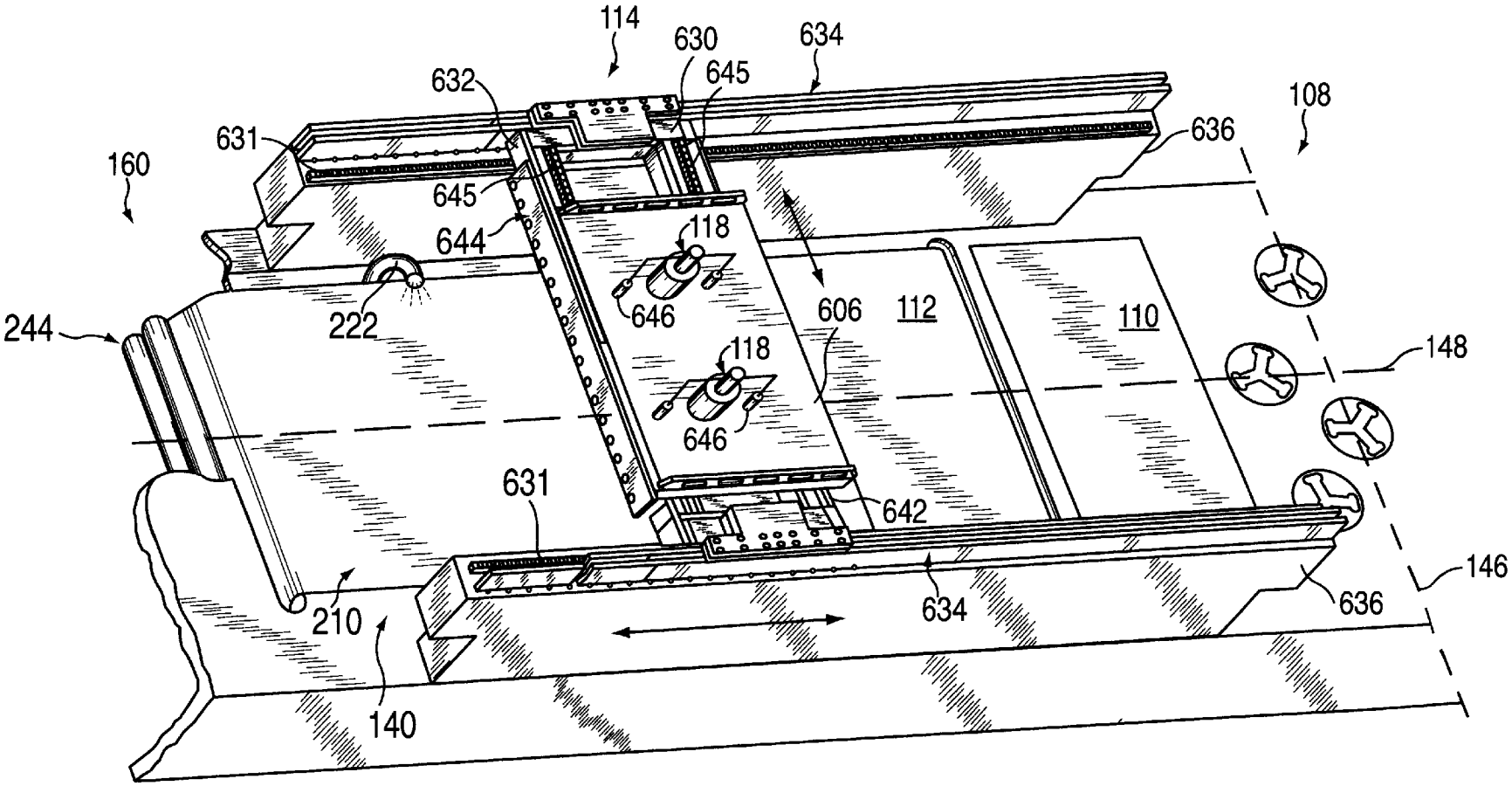
FIG. 6 is a perspective view of a drive system.
Figure 7:
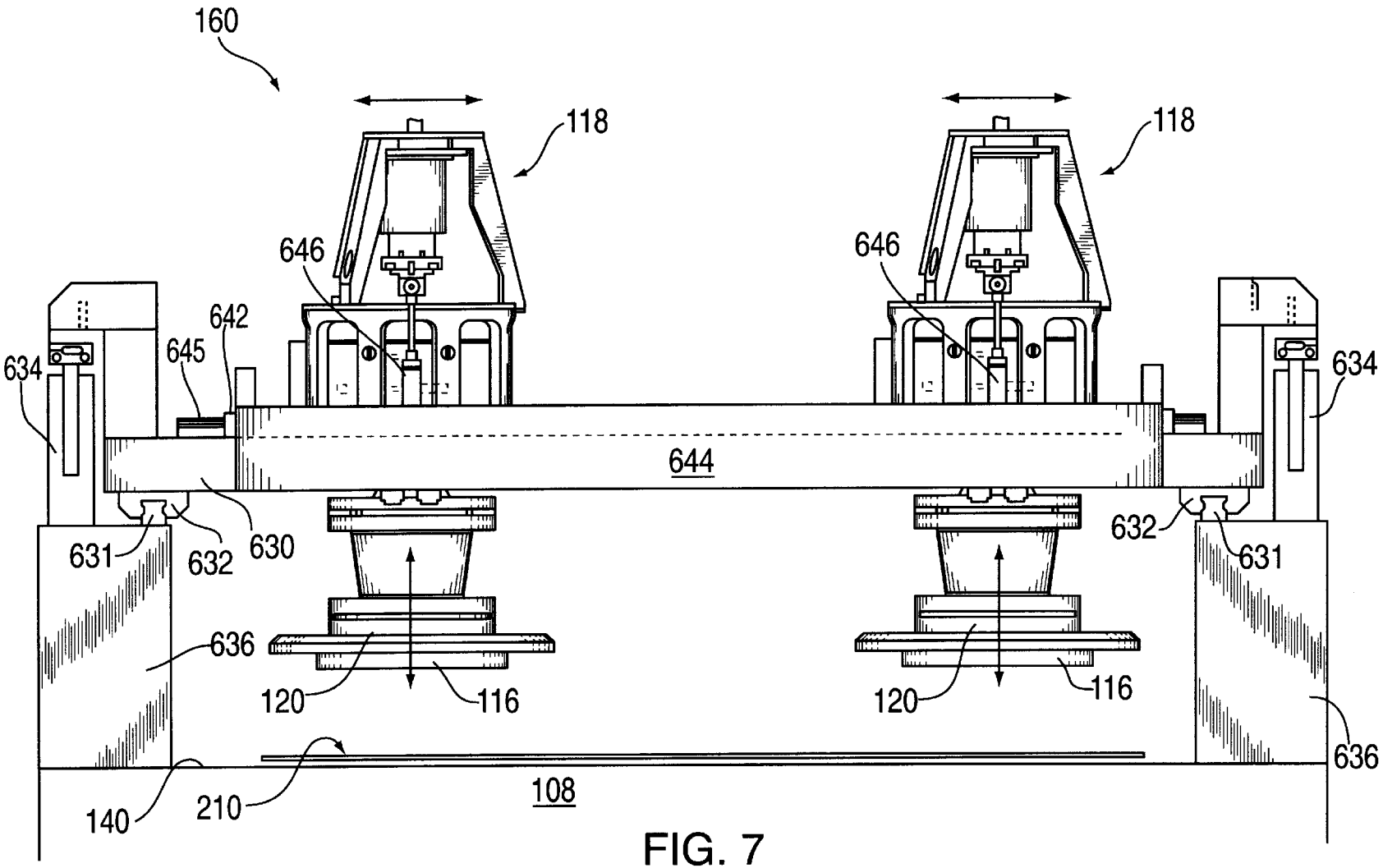
FIG. 7 is a side elevation of the drive system of FIG. 5.

FIGS. 6 and 7 are a perspective view and an elevation of one embodiment of the system 100 illustrating the drive system 114 found on the polishing module 160. The drive system 114 is coupled to the base 140. Generally, the drive system 114 moves the polishing head assembly 18 in an x/y motion provided by a first linear motion device 602, and a second linear motion device 604. The drive system 114 may incorporate two or more polishing head assemblies 118. The polishing head assembly 118 includes an actuator 646 that places the substrate 116 in contact with the web 210 or buffing pad 110. The first linear motion device 602 and the second linear motion device 604 (which could be replaced by one device providing at least an equivalent range of motion) couples the polishing head 120 to the base 140. The linear motion devices 602 and 604 move the polishing head assemblies 118 in programmable patterns in relation to the base 140.

The first linear motion device 602 generally comprises a stage 630, a plurality of roller bearing guides 632 (one is shown in FIG. 6) and a driver 634. The stage 630 is fabricated from aluminum or other light weight material. The stage 630 may comprise stiffening ribs to minimize the deflection in a direction normal the base 140. The use of light-weight materials minimizes the inertia of the stage 630 that effects stage motion. The guides 632 are coupled to the stage 630 and interface with rails 631 disposed on supports 636 fixed to the base 140. The guides 632 allows the stage 630 to move along the supports 636 in a linear motion generally perpendicular to the line 146, and substantially parallel to the orientation of the polishing media 210 and buffing pad 110 (i.e., line 148). The guides 632 may alternatively comprise solid bearings, air bearings or similar devices. The driver 634 provides motion to the stage 630 relative the base 140. The driver 634 may comprise "Sawyer" motors, ball screws, cylinders, belts, rack and pinion gears, servo motors, stepper motors and other devices for creating and controlling linear motion. Generally, one portion of the driver 634 is connected to the support 636 while a second portion is connected to the stage 630.

The second linear motion device 604 generally comprises the carrier 606, a roller bearing guide 642 and a driver 644. The carrier 606 is also fabricated from aluminum or other light-weight material. The guide 642 is coupled to the carrier 606 and interfaces with a rail 645 disposed on stage 630. The guide 642 allows the carrier 606 to move along the stage 630 in a linear motion perpendicular to the motion of the stage 632. The guide 642 may alternatively comprise solid bearings, air bearings or similar bearing devices. The driver 644 provides motion to the carrier 606 relative the stage 630. The driver 644 may comprise "Sawyer" motors, ball screws, cylinders, belts, rack and pinion gears, servo motors, stepper motors and other devices for creating and controlling linear motion.

The carrier 606 supports the two or more polishing head assemblies 118. In one embodiment, the polishing head assemblies 118 include two polishing heads 120 such as a Titan Head™ or Diamond Head™ wafer carrier available from Applied Materials, Inc., Santa Clara, Calif.

The two or more polishing heads 120 are coupled to the drive system 114 that positions the polishing heads 120 selectively above the web of polishing media 210, the buffing pad 110 or a respective load cup 106. Generally, at least two polishing heads are coupled to a single drive system. However, a drive system having more than two heads, and systems having multiple polishing modules may be devise through the teachings disposed herein. An example of a linear drive system having web which may be modified to incorporate the advantages of the invention is described in U.S. patent application Ser. No. 08/961,602, by Sommer and is hereby incorporated by reference.

Referring back to FIG. 1, one or more staging platforms may be optionally disposed on the base 140 of the system 100. Generally, the staging platforms are positioned proximate the load cups 108 such that the transfer robot 108 may dispose a substrate thereon while attending to the transfer of substrate located in other positions. For example, unprocessed substrates 116 may be retrieved from the cassette 102 and queued on a first platform 170 and second platform 172 if the load cups 142 and 144 contain substrates waiting to be polished during the normally idle time of the transfer robot 106. Generally, the platforms 170 and 172 are configured to support the substrate while allowing the gripper 318 of the transfer robot 106 to easily pick and place the substrate therefrom without damaging the substrate. Since the distances between the platforms 170, 172 and the load cups 142, 144 are shorter than the distance between the cassette 102 and the load cups 142, 144, the time required for the transfer robot 106 to load the load cups 142, 144 is minimized. Optionally, one or more of the platforms may be used to stage process substrates removed from the load cups 150, 152.

Figure 8:
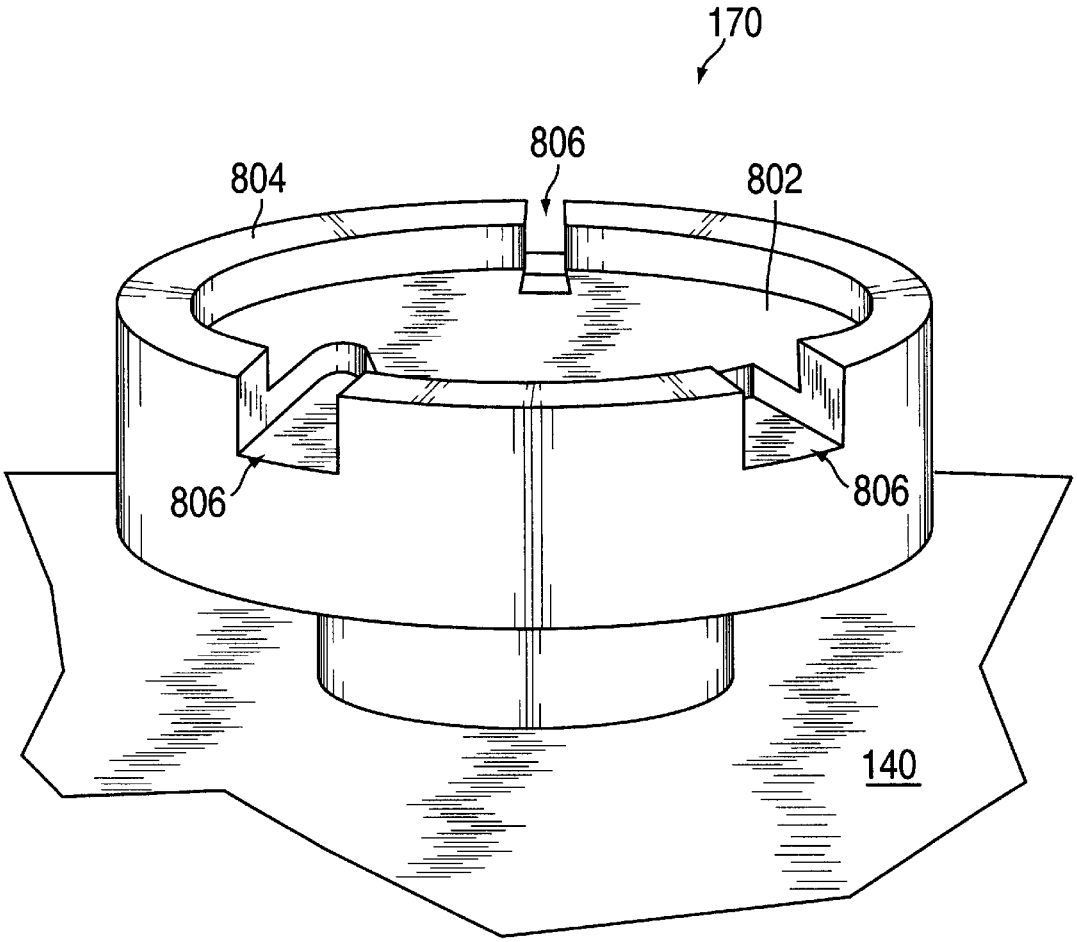
FIG. 8 is one embodiment of a transfer platform.

FIG. 8 depicts one embodiment of the transfer platform 170. Other transfer platforms may be readily substituted. The transfer platform 170 generally provides a staging surface on which the substrate 116 may be temporarily deposited by the transfer robot 106. The transfer platform 170 may include a support surface 802 that is parallel to the base 140. The support surface 802 has a circumferential ring 804 extending therefrom. The ring 804 has a larger diameter than the substrate 116 and retains the substrate on the support surface 802 while the substrate is positioned on the platform 170. The ring 804 and support surface 802 include a plurality of slots 806. The slots 806 are configured to allow the gripper mechanism (i.e., gripper fingers or vacuum blade) of the transfer robot 106 to secure the substrate without contacting the platform. One example of such a platform is described in U.S. patent application Ser. No. 09/414,771, (attorney docket number 3651-02) filed Oct. 6, 1999, by Tobin, and is hereby incorporated by reference in its entirety.

Referring primarily to FIG. 1, in operation, the transfer robot 106 retrieves an unprocessed substrate 116 from one of the wafer cassettes 102 and transfers the substrate 116 to one of the load cups 142 or 144. If the load cups 142, and 144 are occupied with other unprocessed substrates, the substrate retained in the transfer robot's gripper 318 is placed on one of the transfer platforms 170, 172 until one of the load cups 142, 144 becomes empty.

Once the load cups 142, 144 contain substrates for processing, the polishing module 160 retrieves the pair of substrates 116 residing in the first and second load cups 142, 144 by moving the polishing head 120 above the load cups. From this position, the load cups 142, 144 is raised to mate with the polishing head 120 to insure substrate alignment in the polishing head 120 after substrate transfer. The substrates 116 retained in the polishing heads 120 supported by the carrier 606 are moved over the working surface 212 of the polishing media 210 (e.g., the pad 112). The polishing heads 120 are lowered to contact the substrates 116 against the working surface 212 of the polishing media 210. The driver 114 of the polishing module 160 moves the both polishing heads 120 and the substrates 116 retained therein in a programmed polishing pattern to planarize the substrates 116. Optionally, a slurry or other fluid may be disposed between the substrates 116 and the polishing media 210 through the nozzle 222. The process of linearly polishing a wafer is described by Hoshizaki et al., in the previously incorporated U.S. Pat. No. 5,908,530.

Upon completion of processing, the substrates 116 are lifted off the polishing media 210 and transferred to the buffing pad 110 in the polishing head assembly 118. The polishing heads 120 are lowered to contact the substrates 116 against the surface of the buffing pad 110. The driver 114 of the polishing module 160 moves the carrier 606 in a programmed polishing pattern to buff the substrates 116. Optionally, a slurry or other fluid may be disposed between the substrates 116 and the buffing pad 110.

Once buffing is completed, the substrates 116 are lifted from the buffing pad 110 and moved to the third and four load cups 150, 152 by the drive system 114. Once the substrates are released into the load cups 150, 152, the carrier 606 moves to position the polishing heads 120 over the load cups 142, 144 to retrieve another set of substrates to be processed. The use of the two sets of load cups to facilitate loading and off loading of the polishing module increases the throughput of the system 100. Having a second set of substrates available for processing positioned closely to the release point of the process substrates allows the second set of substrates to be loaded into the polishing heads 120 with minimal movement (and time expenditure) of the drive system 114, thus advantageously increasing the system's throughput.

The processed substrates 116 are retrieved sequentially by the transfer robot 106 from the third and fourth load cups 150, 152. The substrates are generally placed in the cassettes 104 disposed in the tub 132 so that the substrates do not dry and allow any contamination disposed thereon to harden before cleaning at a remote location.

Optionally, the substrates may be routed to the metrology system 138 where process data such as film thickness may be acquired. If necessary, substrates may be queued for measuring on one or both of the transfer platforms 170, 172. The transfer platforms 170, 172 utilize the idle time of the transfer robot 106 to queue substrates closer to the location where they will next be needed. Thus, the shorten distances traveled by the transfer robot 106 between the platforms 170, 172 and the load cups 108 yields increased throughput by minimizing transfer time by shortening the distance the transfer robot 106 travels while making substrate exchanges.

The above described routing of the substrate 116 through the system 100 is but one example of a possible processing sequence for a substrate 116 to be processed by the system 100. Alternatively, the substrate 116 may be processed by one or more processing modules or buffing pads, may be processed by the same module or station more than once, may be returned to the cassette during processing and subsequently retrieved into the system 100 for additional processing at a later time, or processed using another processing sequence.

Although the teachings of the present invention that have been shown and described in detail herein, those skilled in the art can readily devise other varied embodiments that still incorporate the teachings and do not depart from the spirit of the invention.

What is claimed is:

1. A processing system for processing multiple workpieces simultaneously comprising:

a first set of load cups;

a second set of load cups nested with the first set of load cups a carrier;

a first polishing head coupled to the carrier;

a second polishing head coupled to the carrier;

one or more polishing pads disposed adjacent the second set of load cups; and a drive system having the carrier coupled thereto, the drive system adapted to move the first polishing head and the second polishing head between positions above the first set of load cups, the second set of load cups and the polishing pads.

2. The system of claim 1, wherein the first set of load cups define a first line and the second set of load cups define a second line, wherein a distance between the first line and the second line is less than a diameter of a load cup.

3. The system of claim 1 further comprising:

at least one wafer cassette; and a transfer robot adapted to transfer substrates between the cassette and the load cups.

4. The system of claim 3 further comprising:

a rail having the transfer robot movably coupled thereto.

5. The system of claim 3 further comprising:

a metrology system wherein the transfer robot may place and retrieve substrates therefrom.

6. The system of claim 3 further comprising:

at least one transfer platform wherein the transfer robot transfers substrates between the transfer platform and the first set of load cups.

7. The system of claim 6, wherein the platform further comprises:

a support surface; and a circumferential ring extending from a perimeter of the support surface.

8. The system of claim 1 further comprising:

a buffing pad disposed between the second set of load cups and the polishing pad.

9. The system of claim 1, wherein the polishing pad is a web.

10. The system of claim 9, wherein the web is orientated parallel to an orientation of the first set of load cups.

11. The system of claim 1, wherein the first set of load cups comprise at least two load cups.

12. The system of claim 11, wherein the second set of load cups comprise at least two load cups.

13. The system of claim 1 further comprising:

at least a second carrier having at least two polishing heads; and at least a second drive system adapted to move the second carrier.

14. The system of claim 13 further comprising:

at least a second polishing media adapted to polish substrates in the second carrier.

15. The system of claim 1 further comprising:

a buffing pad disposed between the polishing pad and the second set of load cups.

16. The system of claim 1 further comprising:

a rinse arm having one or more fluid nozzles, the rinse arm adapted to dispense a fluid on the first set of load cups, the second set of load cups, and a polishing media.

17. A processing system for processing multiple workpieces simultaneously comprising:

a first set of load cups;

a second set of load cups nested with the first set of load cups a carrier;

a first polishing head coupled to the carrier;

a second polishing head coupled to the carrier;

one or more polishing pads disposed adjacent the second set of load cups;

at least one wafer cassette;

a transfer robot adapted to transfer substrates between the cassette and the load cups;

a drive system adapted to move the first polishing head and the second polishing head between positions above the first set of load cups, the second set of load cups and the polishing media.

18. The system of claim 17 further comprising:

at least one transfer platform wherein the transfer robot transfers substrates between the transfer platform and the first set of load cups.

19. The system of claim 18 further comprising:

a buffing pad disposed between the second set of load cups and the polishing pad.

20. A processing system for processing multiple workpieces simultaneously comprising:

a polishing module for processing substrates;

a first set of load cups disposed proximate the polishing module for receiving processed substrates; and a second set of load cups nested with the first set of load cups for receiving substrates to be processed.

21. A processing system for processing multiple workpieces simultaneously comprising:

a polishing module having a center line and having a pair of polishing heads;

a first set of load cups disposed proximate the polishing module for transferring substrates to the polishing heads and defining a first imaginary line perpendicular to the centerline; and a second set of load cups disposed proximate the first set of load cups for receiving substrates from the polishing heads and defining a second imaginary line perpendicular to the centerline, wherein a distance between the imaginary lines is less than about a diameter of one of the load cups.

* * * * *

UNITED STATES PATENT AND TRADEMARK OFFICE

CERTIFICATE OF CORRECTION

PATENT NO. : 6,488,565 B1 
DATED : December 3, 2002
INVENTOR(S) : John M. White et al.

It is certified that error appears in the above-identified patent and that said Letters Patent is hereby corrected as shown below:

Column 2,
Line 12, please change "programable" to -- programmable --.

Column 3,
Line 31, please change "contaminants the" to -- contaminants from the --.

Column 4,
Line 36, please change "orientation" to -- oriented --.
Lines 38 and 54, please change "orientated" to -- oriented --.

Column 6,
Line 45, please change "second 532" to -- second end 532 --.

Column 8,
Line 2, please change "18" to -- 118 --.

Column 9,
Line 4, please change "robot 108" to -- robot 106 --.

Column 11,
Line 40, please change "orientated" to -- oriented --.

Signed and Sealed this

Eleventh Day of March, 2003

JAMES E. ROGAN
*Director of the United States Patent and Trademark Office*